US005770351A

United States Patent [19]

Long et al.

[11] Patent Number: 5,770,351

[45] Date of Patent: Jun. 23, 1998

[54] PROCESSING OF MONOCHROME PHOTOGRAPHIC SILVER HALIDE PRINT MATERIAL

[75] Inventors: William Edward Long, Wilmslow; Michael John Parker, Saffron Walden, both of England

[73] Assignee: Ilford Limited, Switzerland

[21] Appl. No.: 860,737

[22] PCT Filed: Nov. 30, 1995

[86] PCT No.: PCT/GB95/02796

§ 371 Date: Aug. 15, 1997

§ 102(e) Date: Aug. 15, 1997

[87] PCT Pub. No.: WO96/21886

PCT Pub. Date: Jul. 18, 1996

[30] Foreign Application Priority Data

Jan. 12, 1995 [GB] United Kingdom ..... 9500624

[51] Int. Cl.[6] ..... G03C 5/29

[52] U.S. Cl. ..... 430/438; 430/436; 430/439; 430/440; 430/478; 430/480; 430/481; 430/482; 430/483; 430/489

[58] Field of Search ..... 430/436, 438, 430/439, 440, 478, 480, 481, 482, 483, 489

[56] References Cited

U.S. PATENT DOCUMENTS 3,615,512 10/1971 Ducrocq et al. ..... 430/456
4,070,188 1/1978 Nakamura et al. ..... 430/390
4,777,118 10/1988 Kitchin et al. ..... 430/264
4,975,354 12/1990 Machonkin et al. ..... 430/264

FOREIGN PATENT DOCUMENTS

A-1325397 3/1986 U.S.S.R. .

*Primary Examiner*—Hoa Van Le
*Attorney, Agent, or Firm*—Ostrager Chong Flaherty & Onofrio

[57] ABSTRACT

There is described a method of processing silver halide photographic material in a processing machine using a developing solution which comprises either a hydroquinone type developing agent or a reductone type developing agent, together with an electron transfer agent as an auxiliary developing agent, and with at least one basic compound the anion of which is carbonate, sulphite or hydroxide, where in the presence of a compound of formula (I), Ar is an aromatic ring or heterocyclic aromatic ring which is optionally substituted.

(I)

15 Claims, No Drawings

PROCESSING OF MONOCHROME PHOTOGRAPHIC SILVER HALIDE PRINT MATERIAL

Methods and techniques of photographic processing are well known, and are described for example, in the books Photographic Processing Chemistry by LFA Mason, published by the Focal Press in 1975, and Modern Photographic Processing by G. M. Haist, published by Wiley—Interscience in 1979. One well known method is to use a photographic processing machine comprising roller guides which feed the photographic material from one tank containing a photographic processing solution to the next. One of the troubles encountered when photographic material is processed in a machine comprising roller guides is the occurrence of physical development fog which exhibits itself as black silver marks on the processed print material present in a random fashion. It is not clear in some circumstances what causes this physical development of the silver but often in roller transport processing machines, the photographic material is fed from the tank containing the developing solution to the tank containing the fixer solution without any intermediate washing step. Also, to speed up processing, the temperature of the solutions in such machines is 30° C. or above. When such machines are in use, a certain concentration of fixed-out silver builds up in the fixing solution. Processing conditions of this type tend to promote physical development fog. This physical development fog is thought to be caused by some developing solution still in the active state, being carried over into the fixing solution on the print material. This causes some fixed out silver which is in solution in the fixing bath to be developed into metallic silver which then is deposited on the print being processed. Various developing solution stabilizers have been tried to prevent this physical development fog but most are ineffective or have other deleterious effects. For instance, one or two which lessen physical development fog also cause bronzing of the print material which is highly undesirable.

Therefore it is the object of the present invention to provide a method of processing photographic print material wherein the occurrence of physical development fog is greatly reduced.

Therefore according to the present invention there is provided a method of processing silver halide photographic material in a processing machine using a developing solution which comprises either a hydroquinone type developing agent or a reductone type developing agent, together with an electron transfer agent as an auxiliary developing agent, and with at least one basic compound the anion of which is carbonate, sulphite or hydroxide, and a compound of formula I:

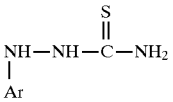

I where Ar is an aromatic ring or heterocyclic aromatic ring which is optionally substituted.

The method of the present invention is of particular use when the photographic material is print material which when it is processed is fed from the tank containing the developing solution to a tank containing the fixer solution without any intermediate washing step. Therefore according to this aspect of the present invention is a method of processing silver halide print material in a roller transport processing apparatus using a developing solution at a temperature of at least 30° C. and wherein the print material is fed out of the developing solution straight into a fixing solution, the developing solution comprising either a hydroquinone type developing agent or a reductone developing agent, together with an electron transfer agent as an auxiliary developing agent, and with at least one basic compound the anion of which is carbonate, sulphite or hydroxide, there being present in the developing solution a compound of formula I:

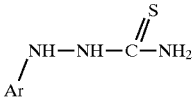

I where Ar is an aromatic or heterocyclic aromatic ring which may be substituted. Suitable substituent groups comprise sulphonic acid groups and salts thereof, carboxylic acid groups and salts thereof halide for example fluoride or chloride, lower alkyl such as methyl or ethyl, lower alkoxy for example methoxy, or sulphonamide or carboxamide groups. Compounds of formula I are compounds which may be prepared by known methods, and in particular by reaction between substituted phenyl hydrazine compounds and potassium thiocyanate.

Preferably the aromatic ring is a phenyl ring.

Most preferably the compound of formula I has the formula II:

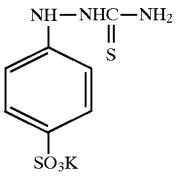

II

It has been found that if the compound of formula I is present at a concentration of between 0.02 to 0.5 g/liter in the developing solution the physical development of silver on to the print material is greatly reduced.

The compound of formula II is hereinafter referred to as Compound A.

An alternative method of providing a developing solution containing a compound of formula I is to use a precursor compound which breaks down in the developer solution to give the compound of formula I in an active form. An example of such a precursor compound is the compound of formula III:

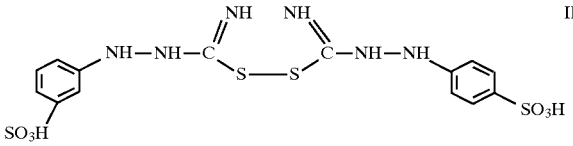

III which is hereinafter referred to as Compound B.

This is the disulphide of compound A, and may be prepared from it by iodine oxidation. In developing solution in the presence of sulphite compound B breaks down to give compound A.

We have shown in the Examples that follow that the presence of well known developing solution stabilizers does not reduce significantly the undesirable physical development of silver on the print material or that they also cause bronzing of the print material, as shown in Example 4.

Examples of reductone type developing agents are reductone itself which is of the formula HOCH═COHCHO and other compounds which comprise the group —CO—CHOH— or its tautomeric form —COH═COH— such as dihydroxyacetone, tetramethyl reductic acid or ascorbates of the general formula IV:

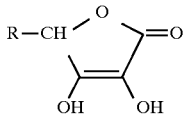

IV or alkali metal salts thereof wherein R represents a hydroxylated alkyl, or compounds of general formula V:

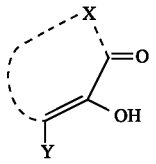

V where X represents the atoms necessary to complete a ring system and Y is a secondary amine group.

Y in formula IV is preferably a cyclic amine for example morpholine or piperidine. An example of a particularly useful reductone of formula IV is the compound of formula VI:

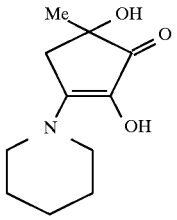

VI

This compound has the trivial name of piperidino-hexose reductone.

Preferred ascorbates of general formula IV for use in the developer solution include L-ascorbic acid, D-isoascorbic acid and L-erythroascorbic acid. Salts of such compounds may also be used.

By hydroquinone type developing agent is meant hydroquinone itself or a substituted hydroquinone such as chlorohydroquinone which acts as a developing agent.

Preferably the amount of reductone developing agent or hydroquinone developing agent present in the working strength photographic developing solution is from 5 to 15 g/liter.

By electron transfer agent is meant a compound which acts synergistically with a reductone or hydroquinone type developing agent to provide an active relatively long lasting developing combination. A large number are known from the patent literature but in practice the two most commonly used ones are amino-phenols such as p-methylaminophenol which is known commercially as Metol and pyrazolidinone compounds of general formula VI

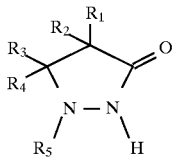

VII in which $R_5$ is an aromatic ring, $R_1$ and $R_2$ are hydrogen, lower alkyl, or hydroxy alkyl, and $R_3$ and $R_4$ are hydrogen, lower alkyl or phenyl. By lower alkyl is meant an alkyl group with up to 3 carbon atoms.

Preferably $R_5$ is phenyl or a substituted phenyl such as 4-methyl phenyl or 4-chloro-phenyl.

A particularly preferred compound for use in the developing solution of this aspect of the present invention is 1-phenyl-4-methyl-4-hydroxymethyl pyrazolid-3-one which is hereinafter referred to as compound C.

Preferably the amount of electron transfer agent present in the working strength developing solution is from 0.2 to 1.5 g/liter.

The preferred pH of the working strength developing solution is from 10 to 11.

It is preferred to include salts of both sulphite and carbonate, the sulphite as a basic compound, as an antioxidant and as a development accelerator (noted in U.S. Pat. No. 5,098,819) and the carbonate as a basic compound and as a buffer in the developing solution when in use. Sufficient sulphite, carbonate and hydroxide should be present to correct the pH of the working solution to between 10 and 11.

Conveniently at least one metal complexing agent is present in the developing solution. A particularly suitable compound is diethylenetriamine pentacetic acid (DTPA).

Other suitable metal complexing agents include phosphonic acids such as 1-hydroxyethylidene 1,1-diphosphonic acid, diethylenetriamine penta (methylenephosphonic acid), ethylene diamine tetra (methylene phosphonic acid) and alkali metal salts thereof.

An alkali metal bromide may be present in the developing solution as a stabiliser or antifoggant.

It is to be understood that the developing solution used in the method of this invention relates to either a concentrated developing solution which requires dilution with water to prepare a working strength solution or to a working strength developing solution. It also relates to powder developing compositions which are required to be dissolved in water.

The accompanying Examples will serve to illustrate the invention.

They show the benefits of adding compounds of formula I to developing solutions in the concentration range 0.02 to 0.5 g/liter. Whilst compounds of formula I can be added to the fixer solution following the development step, the effect on physical development fog is too small to be useful even at concentrations as high as 1 $gl^{-1}$ in the working strength fixer.

There is described in U.S. Pat. No. 3,615,512 a photographic monobath composition for developing direct-print photographic composition comprising (1) a silver halide developing agent, (2) a water-soluble thiocyanate silver halide solvent and (3) a weak silver halide complexing agent which is not capable of reducing silver halide to metallic silver.

In Example I of U.S. Pat. No. 3,615,512 there is described the processing of photographic material which comprises certain compounds including phenyl thiosemicarbazide. These compounds when present on the photographic material are said to counteract the inhibition of dissolving speed in the potassium thiocyanate containing monobath.

In Russian patent SU 1325397-A there is described a monobath developing solution which comprises thiosemicarbazide as a complex-forming component.

EXAMPLE 2

A ready to use silver halide developing solution was prepared to the following formula:

| | |
|---|---|
| Potassium sulphite (65% w/v) | 62 $cm^3$ |
| DTPA $Na_5$ (37% w/v) | 6.8 $cm^3$ |
| Diethylene glycol | 22 $cm^3$ |

-continued

| | |
|---|---|
| Hydroquinone | 9 g |
| Potassium carbonate | 34 g |
| Boric acid | 5 g |
| Compound C | 0.8 g |
| Potassium bromide | 1.5 g |
| Potassium hydroxide | 9 g |
| | Water to 1 liter |

pH 10.60

This was developer 1 which contained no antifoggant compound. 3×1 liter portions of this developer were prepared:

| | |
|---|---|
| To the first was added 0.01 $gl^{-1}$ phenyl mercapto tetrazole | (comparative) |
| To the second was added 0.04 $gl^{-1}$ benzotriazole | (comparative) |
| To the third was added 0.2 $gl^{-1}$ Compound A | (invention) |

Each developer was used to process silver halide photographic print material as follows:

An unexposed 10"×8" sheet of the above print material was dish developed for 30 seconds. The sheet was partially drained of developer and then fed into the fixer rack of a roller transport processing machine. This was done such that the silver halide photographic print material was at an angle of at least 60° to the vertical, thus ensuring a build up of developer on the entry rollers of the fixer rack. The sheet of silver halide photographic print material was fixed, washed and dried by the roller transport processing machine and then visually assessed.

It was found that Developer 1 formulated with benzotriazole resulted in high density marks at the edges of the sheet, as well as an uneven fog density across the whole of the sheet. Developer 1 formulated with phenyl mercapto tetrazole gave a less pronounced edge density and a lower level of fog but was still unacceptable. Developer 1 formulated with compound A gave complete freedom from edge density or fog and was totally acceptable, despite being processed in a way that was expected to produce physical development fog.

The amount chosen for the three anti-foggants is a function of their activity. If 0.2 $gl^{-1}$ of phenyl mercaptotetrazole or benzotriazole had been used there would have been no development of the image. On the other hand 0.2 $gl^{-1}$ of compound A is the preferred amount.

EXAMPLE 2

A ready to use silver halide developing solution was prepared to the following formula:

| | |
|---|---|
| Potassium sulphite (65% w/v) | 30 $cm^3$ |
| DTPA $Na_5$ (37% w/v) | 6.8 $cm^3$ |
| Compound C | 0.8 g |
| Sodium-1-Ascorbate | 35 g |

-continued

| | |
|---|---|
| Potassium carbonate | 40 g |
| Potassium bromide | 2.3 g |
| Potassium hydroxide | 9 g |
| | water to 1 liter |

pH=10.30

This was developer 2, which was an ascorbate based developer containing no antifoggant compound. 3×1 liter portions of this developer were prepared:

| | |
|---|---|
| To the first was added 0.01 $gl^{-1}$ phenyl mercapto tetrazote | (comparative) |
| To the second was added 0.04 $gl^{-1}$ benzotriazole | (comparative) |
| To the third was added 0.2 $gl^{-1}$ 1 compound A. | (invention) |

Each developer was used to process silver halide photographic print material as described in Example 1. Results obtained were very similar to those seen in Example 1 with only compound A giving a completely acceptable result.

It can be seen that whilst Examples 1 and 2 gave a clear visual demonstration of the benefits of compound A, it was not possible to quantify these benefits because of the random nature of physical development fog under such circumstances. In Examples 1 and 2 physical development fog was induced by carry over of active developer into fixer solutions on the processed paper. For reproducibility and ease of measurement, physical development fog was induced in the examples which follow by deliberate contamination of developer solution with fixer. Although less common than carry over of developer into fixer, such accidental contamination is not unknown, with similar deleterious consequences.

EXAMPLE 3

A ready to use silver halide developing solution was prepared to the following formula:

| | |
|---|---|
| Potassium sulphite (65% w/v $sol^n$) | 62 $cm^3$ |
| DTPA $Na_5$ (37% w/v $sol^n$) | 6.8 $cm^3$ |
| Diethylene glycol | 22 $cm^3$ |
| Hydroquinone | 9 g |
| Potassium carbonate | 34 g |
| Boric acid | 5 g |
| Compound C | 0.8 g |
| Potassium bromide | 1.5 g |
| Benzotriazole | 0.04 g |
| Potassium hydroxide | 9 g |
| | water to 1 liter |

pH 10.60

This was developer 3 and it contained no compound of formula I. (comparative)

Developer 4 had the same formulation but in addition contained 0.2 $gl^{-1}$ of compound A. (invention)

Developer 5 to 15 were formulated as developer 3 but in addition had the following compounds added:

| DEVELOPER | CONCENTRATION/ADDITIVE |
|---|---|
| 5:0.13 $gl^{-1}$ (comparison) | 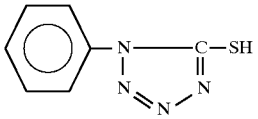 (1 phenyl mercapto-tetrazole) |
| 6:0.08 $gl^{-1}$ (comparison) | 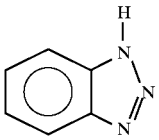 (benzotriazole) |
| 7:0.11 $gl^{-1}$ (comparison) | 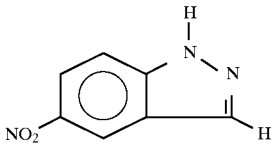 |
| 8:0.11 $gl^{-1}$ (comparison) | 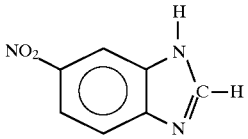 |
| 9:0.22 $gl^{-1}$ (comparison) | 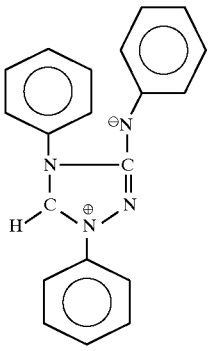 |
| 10:0.10 $gl^{-1}$ (comparison) | 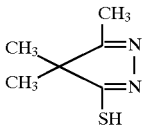 |
| 11:0.22 $gl^{-1}$ (comparison) | 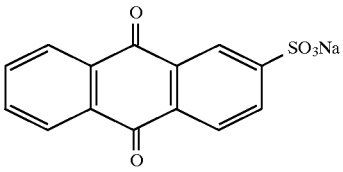 |
| 12:0.12 $gl^{-1}$ (invention) | 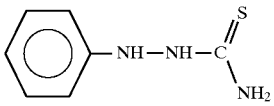 |

-continued

| DEVELOPER | CONCENTRATION/ADDITIVE |
|---|---|
| 13:0.18 $gl^{-1}$ (comparison) | 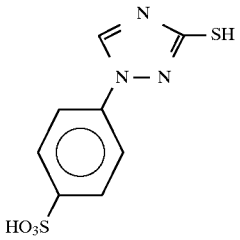 |
| 14:0.15 $gl^{-1}$ (comparison) | 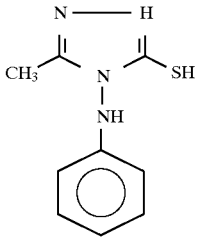 |
| 15:0.35 $gl^{-1}$ (invention) | 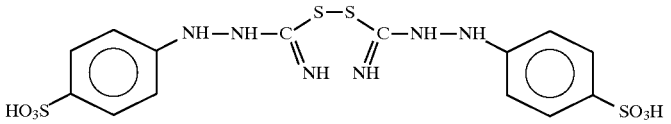 |

The concentrations used were molar equivalents to 0.2 $gl^{-1}$ of compound A.

The compounds which were added to developers 5 to 11 are well known antifoggants from the photographic literature.

Developers 3 to 15 were contaminated with 12 $cm^3$ of fixer prepared to the following formula:

| | |
|---|---|
| Ammonium thiosulphate (80% w/v) | 150 $cm^3$ |
| Boric acid | 7 g |
| Sodium hydroxide | 2.5 g |
| Sodium metabisulphite | 5 g |
| Sodium sulphite | 6 g |
| Acetic acid (glacial) | 9 $cm^3$ |
| | water to 1 liter |

This is hereinafter referred to as Fixer I.

Developer 16 was prepared as Developer 3 but was not contaminated with fixer I. invention)

Developers 3 to 16 were used to process unexposed photographic print material. After processing the density of each sample of photographic print material was measured by a reflection densitometer giving the results set out in Table I.

TABLE 1

| DEVELOPER | REFLECTION DENSITY |
|---|---|
| 3 | 0.42 |
| 4 | 0.16 |
| 5 | 0.42 |
| 6 | 0.55 |
| 7 | 0.54 |
| 8 | 0.55 |
| 9 | 0.43 |
| 10 | 0.44 |
| 11 | 0.47 |

TABLE 1-continued

| DEVELOPER | REFLECTION DENSITY |
|---|---|
| 12 | 0.06 |
| 13 | 0.29 |
| 14 | 0.36 |
| 15 | 0.14 |
| 16 | 0.03 |

It can be seen that Developer 4, containing compound A, and the inventive Developers 12 and 15 are the least sensitive to the effects of fixer contamination. Indeed in the case of developer 12 the effect is almost eliminated when compared with the uncontaminated developer 16.

Developers 4 and 15 have very similar effects, as would be expected as the active species is the same in each developer.

EXAMPLE 4

A ready to use silver halide developing solution was prepared to the formula given in Example 1

This was developer 1, and 3×1 L portions of this developer were prepared:

| | |
|---|---|
| The the first was added 0.01 $gl^{-1}$ phenyl mercapto tetrazole. | (comparative) |
| To the second was added 0.04 $gl^{-1}$ benzotriazole. | (comparative) |
| To the third was added 0.2 $gl^{-1}$ compound A. | (invention) |

Each developer was used to process silver halide photographic print material which had previously been exposed through a continuous wedge. The results obtained are set out in Table 1 which follows. In this table:

Dmin is minimum density
Ds is 90% of Dmax (maximum density)
Contrast is the difference between logE values at Dmin+0.04 and Ds.
Speed is measured at a density of 0.6+Dmin.
'a' is a measure of redness or greenness of an image.
'b' is a measure of blueness or yellowness of an image.

TABLE 1

| Developer 1+ | D min | Ds | Contrast | Speed | 'a' | 'b' |
|---|---|---|---|---|---|---|
| Phenyl mercapto tetrazole | 0.01 | 1.89 | 0.88 | 2.29 | 0.6 | 0.3 |
| Benzotriazole | 0.00 | 1.86 | 0.90 | 2.30 | 0.6 | 0.1 |
| Compound A | 0.00 | 1.88 | 0.89 | 2.24 | 0.5 | 0.8 |

The results show that compound A caused a slight speed loss but gave otherwise similar sensitometric results to the other compounds tested. Compound A also gave a more negative 'b' value, that is, a colder image colour.

The above three developers were also used to process silver halide photographic print material exposed through a step wedge. For each developer two strips were processed. One was retained as a reference, the other was subjected to treatment as follows in order to assess silver image stability: This test is equivalent to the standard ANSI test method for bronzing of photographic images.

Each test strip was mounted, emulsion side out, in a cylindrical perspex sample holder 14 cm in diameter. This was placed in a desiccator and rested on a perforated plate. Beneath this plate, at the bottom of the desiccator, was a petri dish containing 10 g of potassium chloride added to 20 $cm^3$ of saturated potassium chloride solution. On top of the perforated plate, between the plate and the sample holder was a 16 $cm^2$ piece of chromotography paper moistened with 80 $\mu$l of 4.8% w/v hydrogen peroxide solution. The desiccator was sealed with a lid containing a small electrically driven fan such that the atmosphere in the desiccator was agitated.

The sealed desiccator was placed in an oven which had been preheated to 50° C., and the fan was run for 1 hour. The apparatus was left in the oven for a further 17 hours incubation before being removed and the test strips withdrawn.

The density of each strip was measured on a reflection densitometer and subtracted from the densities recorded on the same steps on the untreated reference sample. Strips were also visually examined for their appearance, and all results obtained are presented below in Table 2.

TABLE 2

| | Density Difference from step: | | | | | | | | |
|---|---|---|---|---|---|---|---|---|---|
| Developer 1+ | 1 | 2 | 3 | 4 | 5 | 6 | 7 | 8 | Appearance |
| phenyl mercapto tetrazole | −0.05 | −0.02 | −0.01 | −0.02 | −0.04 | −0.07 | −0.15 | −0.03 | yellow stain |
| benzotriazole | −0.05 | −0.01 | +0.01 | 0.00 | 0.00 | 0.00 | 0.00 | −0.01 | no stain |
| compound A | −0.05 | −0.04 | −0.02 | 0.00 | +0.01 | 0.00 | 0.00 | 0.00 | no stain |

These results show that all strips lost some of their maximum density following this treatment but the strip processed in the developer containing phenyl mercapto tetrazole lost density across the exposure range, especially in the low density areas. In addition this strip exhibited a marked yellow stain which was absent from the other test strips. This yellow stain is commonly referred to as bronzing.

In the final test the above three developers were contaminated with 12 $cm^3$ of Fixer I. Each was used to process unexposed photographic print material, after which the density of each sample was measured using a reflection densitometer. Results obtained are presented in Table 3.

TABLE 3

| Developer 1+ | Density |
|---|---|
| phenyl mercapto tetrazole | 0.03 (comparative) |
| benzotriazole | 0.07 (comparative) |
| compound A | 0.00 (invention) |

These results show that compound A completely eliminates the deleterious effects of fixer at the chosen level of contamination; phenyl mercapto-tetrozole is only partially effective, benzotriazole is even less effective.

In conclusion these results show that compound A, when added to a photographic developer gives acceptable sensitometric results compared to two other well known photographic antifoggants. Further compound A gives very good protection against fog produced by fixer contamination and results in a stable silver image. Benzotriazole is riot detrimental to image stability but gives little protection against fog produced by fixer contamination. Phenyl mercapto tetrazole gives some protection against fog produced by fixer contamination but is detrimental to image stability.

EXAMPLE 5

A ready to use silver halide developing solution was prepared as detailed in Example 2. This was developer 2, which was an ascorbate based developer containing no antifoggant compound. 3×1 L portions of this developer were prepared:

| | |
|---|---|
| To the first was added 0.01 $gl^{-1}$ phenyl mercapto tetrazole | (comparative) |
| To the second was added 0.04 $gl^{-1}$ benzotriazole | (comparative) |
| To the third was added 0.2 $gl^{-1}$ compound A | (invention) |

Each developer was used to process silver halide photographic print material as described in Example 4. The results obtained are set out in Table 4:

TABLE 4

| Developer 2+ | D min | Ds | Contrast | Speed | 'a' | 'b' |
|---|---|---|---|---|---|---|
| Phenyl mercaptotetrazole | 0.01 | 1.90 | 0.87 | 2.30 | 0.5 | 0.6 |
| Benzotriazole | 0.01 | 1.92 | 0.89 | 2.29 | 0.4 | 0.1 |
| Compound A | 0.00 | 1.87 | 0.88 | 2.22 | 0.6 | 0.5 |

The results show that compound A caused a small speed loss but gave otherwise similar sensitometric results to the other compounds tested. Compound A also gave a more negative 'b' value, that is a colder image colour.

The above three developers were also used to process silver halide photographic print material exposed through a step wedge. For each developer two strips were processed. One was retained as a reference, the other was treated as described in Example 4. The results obtained are presented in Table 5.

TABLE 5

| | Density Difference from step: | | | | | | | | |
|---|---|---|---|---|---|---|---|---|---|
| Developer 3+ | 1 | 2 | 3 | 4 | 5 | 6 | 7 | 8 | Appearance |
| phenyl mercapto tetrazole | −0.04 | −0.04 | −0.06 | −0.07 | −0.07 | −0.09 | −0.11 | −0.02 | yellow stain |
| benzotriazole | −0.03 | −0.01 | −0.01 | 0.00 | −0.00 | −0.02 | −0.03 | −0.02 | no stain |
| compound A | −0.07 | −0.08 | −0.03 | −0.01 | +0.01 | +0.01 | +0.02 | +0.01 | no stain |

These results show that all the strips lose some of their maximum density following this treatment but the strip processed in the developer containing phenyl mercaptotetrazole lost density across the entire exposure range. In addition this strip exhibited a marked yellow stain which was absent from the other strips.

In the final test each of the above developers were contaminated with 12 $cm^3$ of Fixer I. Each was used to process unexposed photographic print material, after which the density of each sample was measured using a reflection densitometer. Results obtained are presented in Table 6.

TABLE 6

| Developer 1+ | Density |
|---|---|
| Phenyl mercapto tetrazole | 0.03 (comparative) |
| Benzotriazole | 0.05 (comparative) |
| Compound A | 0.00 (invention) |

In conclusion it can be seen that the three antifoggants tested in ascorbate based developer 2 behave in essentially the same way in hydroquinone based developer 1. Use of compound A is shown to be advantageous compared to the other two well known antifoggant compounds tested.

We claim:

1. A method of processing silver halide photographic material in a processing machine using a developing solution which comprises either a hydroquinone type developing agent or a reductone type developing agent, together with an electron transfer agent as an auxiliary developing agent, and with at least one basic compound the anion of which is carbonate, sulphite or hydroxide, and with a compound of formula I:

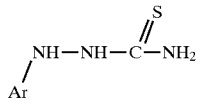

I where Ar is an aromatic ring or heterocyclic aromatic ring which is optionally substituted.

2. A method according to claim 1 of processing silver halide print-material in a roller transport processing apparatus using a developing solution at a temperature of at least 30° C. and wherein the print material is fed out of the developing solution straight into a fixing solution, the developing solution comprising either a hydroquinone type developing agent or a reductone developing agent, together with an electron transfer agent as an auxiliary developing agent, and with at least one basic compound the anion of which is carbonate, sulphite or hydroxide, there being present in the developing solution a compound of formula I:

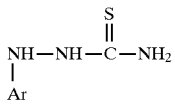

I where Ar is an aromatic or heterocyclic aromatic ring which may be substituted.

3. A method according to claim 1 or claim 2 wherein the compound of formula I Ar is a phenyl ring.

4. A method according to claim 1 or claim 2 wherein the compound of formula I has the formula II:

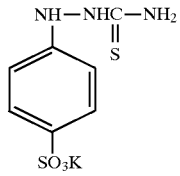

II

5. A method according to claim 1 or claim 2 wherein the compound of formula I is present at a concentration of 0.02 to 0.5 g/litre.

6. A method according to claim 1 or claim 2 wherein the reductone type developing agent is reductone itself, dihydroxyacetone, tetramethyl reductic acid or an ascorbate of the general formula IV:

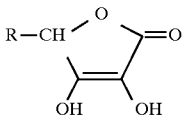

IV or alkali metal salts thereof wherein R represents a hydroxylated alkyl, or compounds of general formula V:

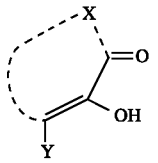

V where X represents the atoms necessary to complete a ring system and Y is a secondary amine group.

7. A method according to claim 6 wherein the ascorbate developing agent of formula III is L-ascorbic acid, D-isoascrobic acid, or L-erythroascorbic acid or a salt of such ascorbate.

8. A method according to claim 1 or claim 2 wherein the amount of reductone developing agent or hydroquinone developing agent present in the working strength photographic developing solution is from 5 to 15 g/litre.

9. A method according to claim 1 or claim 2 wherein the electron transfer agent is p-methylaminophenol or a pyrazolidinone compound of the general formula VI:

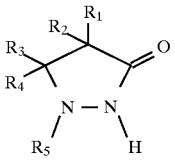

VII in which $R_5$ is an aromatic ring, $R_1$ and $R_2$ are hydrogen, lower alkyl, or hydroxy alkyl, and $R_3$ and $R_4$ are hydrogen, lower alkyl or phenyl.

10. A method according to claim 9 where in formula VII $R_5$ is phenyl or a substituted phenyl.

11. A method according to claim 1 or claim 2 wherein the electron transfer agent is 1-phenyl-4-methyl-4-hydroxymethyl pyrizolid-3-one.

12. A method according to claim 1 or claim 2 wherein the electron transfer agent is present in the working strength developing solution at a concentration of 0.2 to 1.5 g/litre.

13. A method according to claim 1 or claim 2 wherein salts of both sulphite and carbonate are present.

14. A method according to claim 1 or claim 2 wherein a metal completing agent is present in the developing solution.

15. A method according to claim 13 where the metal completing agent is diethylenetriamine pentaacetic acid.

* * * * *

UNITED STATES PATENT AND TRADEMARK OFFICE

CERTIFICATE OF CORRECTION

PATENT NO. : 5,770,351

DATED : June 23, 1998

INVENTOR(S) : Long et al.

It is certified that error appears in the above-indentified patent and that said Letters Patent is hereby corrected as shown below:

Column 4, line 59, delete "EXAMPLE 2" and insert --EXAMPLE 1--;

Column 6, line 16, after $gl^{-1}$ delete "1";

In Claim 7, column 15, line 12, change "III" to --IV--; and

In Claim 9, Column 15, line 21, change "VI" to --VII--.

Signed and Sealed this

Seventeenth Day of November, 1998

Bruce Lehman

*Attest:*

BRUCE LEHMAN

*Attesting Officer*

*Commissioner of Patents and Trademarks*